US009627750B2

(12) United States Patent
Suzuki

(10) Patent No.: US 9,627,750 B2
(45) Date of Patent: Apr. 18, 2017

(54) RADIO DEVICE

(71) Applicant: FUJITSU LIMITED, Kawasaki-shi, Kanagawa (JP)

(72) Inventor: Yusuke Suzuki, Fujisawa (JP)

(73) Assignee: FUJITSU LIMITED, Kawasaki (JP)

( * ) Notice: Subject to any disclaimer, the term of this patent is extended or adjusted under 35 U.S.C. 154(b) by 49 days.

(21) Appl. No.: 14/572,826

(22) Filed: Dec. 17, 2014

(65) Prior Publication Data

US 2015/0263418 A1 Sep. 17, 2015

(30) Foreign Application Priority Data

Mar. 13, 2014 (JP) ..... 2014-050388

(51) Int. Cl.

| | |
|---|---|
| ***H01Q 1/52*** | (2006.01) |
| ***H01Q 1/48*** | (2006.01) |
| ***H01Q 21/28*** | (2006.01) |
| *H01Q 1/38* | (2006.01) |

(52) U.S. Cl.

CPC ..... *H01Q 1/48* (2013.01); *H01Q 21/28* (2013.01)

(58) Field of Classification Search

CPC ..... H01Q 1/52; H01Q 1/38; H01Q 1/241–1/243; H01Q 1/245; H01Q 1/24; H01Q 1/48; H01Q 9/40

USPC ..... 343/702, 846, 848, 893

See application file for complete search history.

(56) References Cited

U.S. PATENT DOCUMENTS

| | | | | |
|---|---|---|---|---|
| 6,133,880 | A | 10/2000 | Grangeat et al. | |
| 8,619,001 | B2 * | 12/2013 | Wakabayashi | H01Q 7/005 343/860 |
| 9,276,319 | B2 * | 3/2016 | Vazquez | H01Q 9/06 |
| 2004/0100406 | A1 * | 5/2004 | Okado | H01Q 9/40 343/700 MS |
| 2007/0001911 | A1 * | 1/2007 | Fujio | H01Q 9/0407 343/700 MS |
| 2009/0079657 | A1 * | 3/2009 | Chung | H01Q 1/2291 343/876 |
| 2012/0229357 | A1 * | 9/2012 | Hung | H01Q 1/243 343/848 |

(Continued)

FOREIGN PATENT DOCUMENTS

| | | |
|---|---|---|
| JP | 11-284430 | 10/1999 |
| JP | 2007-235451 | 9/2007 |

(Continued)

*Primary Examiner* — Dameon E Levi
*Assistant Examiner* — Awat Salih
(74) *Attorney, Agent, or Firm* — Fujitsu Patent Center

(57) ABSTRACT

A radio device includes a rectangular substrate including first and second opposite sides and third and fourth opposite sides; a ground plane formed in the substrate, cut out along the third side from a corner at one end of the second side; a first monopole antenna extending away from the ground plane along the third side from a first feeding unit provided on the third side; a second monopole antenna extending away from the ground plane along the fourth side from a second feeding unit provided on the fourth side; and a ground element formed in the ground plane, extending toward the second side along the third side, from one end of the ground element connected to the ground plane. A length from the first feeding unit through the one end to another end of the ground element corresponds to one fourth of a wavelength of radio waves.

9 Claims, 16 Drawing Sheets

(56) References Cited

U.S. PATENT DOCUMENTS

| | | | | |
|---|---|---|---|---|
| 2012/0287012 | A1* | 11/2012 | Aizawa | H01Q 1/243 343/853 |
| 2012/0299794 | A1 | 11/2012 | Sugimoto et al. | |
| 2013/0057438 | A1* | 3/2013 | Satou | H01Q 1/243 343/702 |
| 2013/0249739 | A1* | 9/2013 | Hsieh | H01Q 1/243 343/700 MS |
| 2013/0314297 | A1* | 11/2013 | Hamabe | H01Q 21/28 343/893 |
| 2016/0182694 | A1* | 6/2016 | Yoshida | H01Q 1/243 455/575.7 |

FOREIGN PATENT DOCUMENTS

| | | | |
|---|---|---|---|
| JP | 2007235451 A | * | 9/2007 |
| JP | 2007-282091 | | 10/2007 |
| JP | EP2120288 | * | 11/2009 |
| JP | 2010153973 | * | 7/2010 |
| JP | 2010206550 | * | 9/2010 |
| JP | 2012-249089 | | 12/2012 |
| JP | 2013-062615 | | 4/2013 |
| JP | 2013062615 A | * | 4/2013 |

* cited by examiner

RADIO DEVICE

CROSS-REFERENCE TO RELATED APPLICATION

This patent application is based upon and claims the benefit of priority of the prior Japanese Patent Application No. 2014-050388 filed on Mar. 13, 2014, the entire contents of which are incorporated herein by reference.

FIELD

The embodiments discussed herein are related to a radio device.

BACKGROUND

A monopole type antenna that is usable in a mobile communication system includes, for example, a rectangular ground plate including a feeding point, and a radiation element having one end connected to the ground plate at the feeding point. The long side of the ground plate and the radiation element collaborate with each other to operate as a dipole antenna (see, for example, Patent Document 1).

Patent Document 1: Japanese Laid-Open Patent Publication No. 2007-282091

Therefore, the size of a ground is determined such that the long side of the ground plate or the ground and the radiation element may collaborate with each other.

Meanwhile, the number of components, the types of components, and the size of the components that are accommodated in the radio device, differ according to the purpose of the radio device. Therefore, in the radio device depending on the purpose of the radio device, it may be difficult to secure a sufficiently large ground such that the long side of the ground and the radiation element may appropriately collaborate with each other. For a monopole type antenna, when an appropriate ground is not secured, the properties of the antenna, such as the gain, may be degraded.

SUMMARY

According to an aspect of the embodiments, a radio device includes a substrate having a rectangular shape including a first edge side and a second edge side constituting opposite sides and a third edge side and a fourth edge side constituting another set of opposite sides; a ground plane formed in the substrate by cutting out an area along the third edge side from a corner part at one end of the second edge side; a first antenna element of a monopole type that extends away from the ground plane along the third edge side from a first feeding unit provided on a side of the third edge side on the substrate; a second antenna element of a monopole type that extends away from the ground plane along the fourth edge side from a second feeding unit provided on a side of the fourth edge side on the substrate; and a ground element formed in the substrate in the area that is cut out to form the ground plane, the ground element extending toward the second edge side along the third edge side, from one end of the ground element that is connected to the ground plane, wherein a length extending from the first feeding unit through the one end of the ground element to another end of the ground element corresponds to a length of one fourth of a wavelength of radio waves that are transmitted/received.

The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

DESCRIPTION OF EMBODIMENTS

Figure 1:
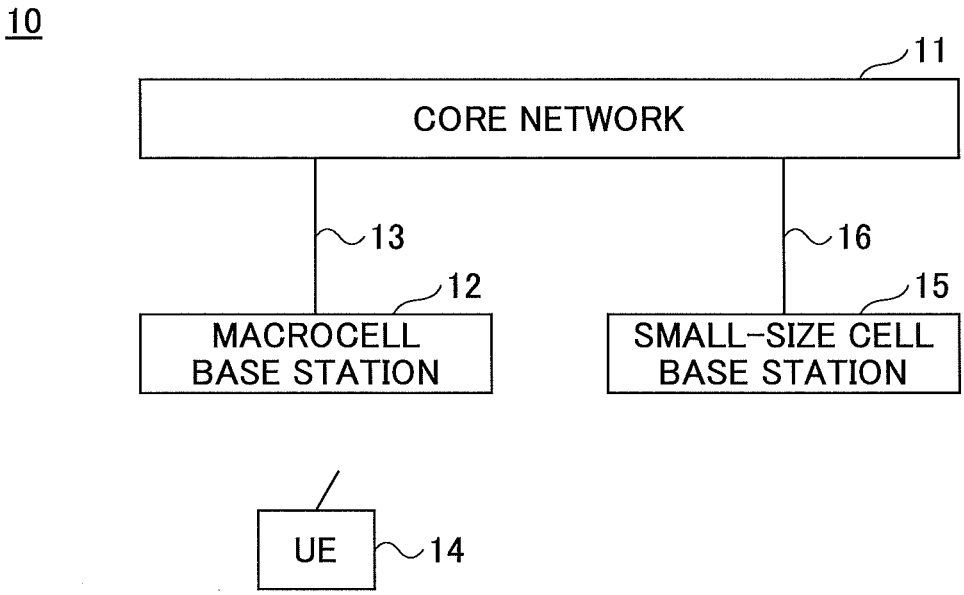
FIG. 1 illustrates a communication system that is used in an embodiment.

Preferred embodiments of the present invention will be explained with reference to accompanying drawings. Throughout the drawings, the same elements are denoted by the same reference numerals.

The following descriptions are given according to the following items.

1. Communication System
2. Radio Device
3. Additional Ground GND5
4. Modification Examples
   4-1. First Modification Example
   4-2. Second Modification Example
   4-3. Third Modification Example
   4-4. Fourth Modification Example
5. Simulation Results
6. Overview The segmentation by the above items is not essential to the embodiments; the points described in two or more items may be combined with each other according to need, or the point described in one item may be applied to a point described in another item (unless they contradict each other).

1. Communication System

FIG. 1 illustrates a communication system 10 that is used in an embodiment. The communication system 10 includes a core network 11, a macrocell base station 12, wired interfaces 13, 16, a user device 14, a small-size cell base station 15. Only one of each of the macrocell base station 12, the user device 14, and the small-size cell base station 15 is illustrated as a matter of simplification; however, any appropriate number may be used.

The communication system 10 may be any appropriate system for providing a mobile communication service or other services to the user device 14. For example, the communication system 10 may be a Long Term Evolution (LTE) type mobile communication system or a LTE-Advanced type mobile communication system. In the communication system 10, various technologies may be used for providing a mobile communication service, etc. For example, an Orthogonal Frequency Division Multiplex (OFDM) method, a Single Carrier-Frequency Division Multiple Access (SC-FDMA) method, an Adaptive Modulation Coding (AMC) method, a Multiple Input Multiple Output (MIMO), method, and a Carrier Aggregation (CA) method may be used.

The core network 11 performs processes for providing a mobile communication service or other services. The core network 11 includes devices (server, router, management node, etc.) of the operator, the provider, etc.; however, these devices are not illustrated as a matter of simplification.

The macrocell base station 12 is an example of a base station for performing mobile communication by a cellular method. The macrocell base station 12 performs wired communication with the core network 11 via the wired interface 13, and also performs wireless communication with the user device 14 via a wireless interface (not illustrated).

The user device 14 is able to receive a mobile communication service or other services via the macrocell base station 12 or the small-size cell base station 15. The user device 14 may be any appropriate device that is able to transmit/receive wireless signals; the user device 14 is typically a mobile terminal, but may be a fixed terminal.

The small-size cell base station 15 is an example of a base station for performing mobile communication via a small-size cell that is narrower than a macrocell. The small-size cell base station 15 performs wired communication with the core network 11 via the wired interface 16, and also performs wireless communication with the user device 14 via a wireless interface (not illustrated). The wired interface 16 may be, for example, a cable for a Local Area Network (LAN).

A macrocell and a small-size cell may be distinguished according to the radius of the cell. For example, a cell having a radius of approximately several hundreds of meters through several kilometers may be referred to as a macrocell. A cell having a radius of approximately several tens of meters through several hundreds of meters may be referred to as a micro cell. A cell having a radius of approximately several tens of meters may be referred to as a nano cell. A cell having a radius of approximately several meters through several tens of meters may be referred to as a pico cell. A cell having a radius of approximately several meters may be referred to as a femto cell. The names of these cells are merely examples that are given as a matter of convenience. For example, a cell that is different from a macro cell may be referred to as a small-size cell. A base station that performs wireless communication with the user device in a small-size cell, and that is connected to the core network, may be referred to as, for example, a femto cell base station unless this causes confusion.

2. Radio Device

Figure 2:
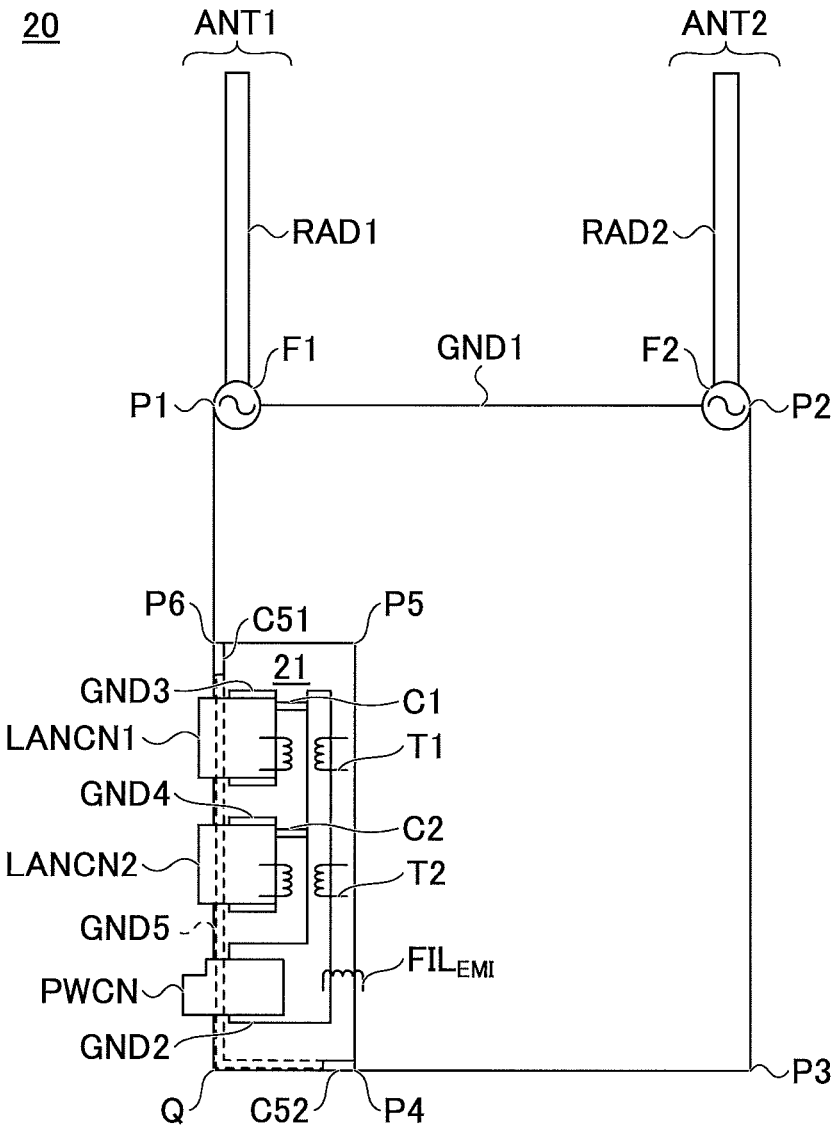
FIG. 2 illustrates a radio device used in an embodiment.

FIG. 2 illustrates a radio device 20 used in an embodiment. The radio device 20 is an example of the small-size cell base station 15 in FIG. 1. The radio device 20 is typically a femto cell base station that is able to perform communication in a femto cell such as inside a house or inside a company; however, the radio device 20 is not limited to a femto cell base station. FIG. 2 illustrates various elements that are selected from the perspective of describing the embodiment, among various elements included in the small-size cell base station.

Figure 3A:
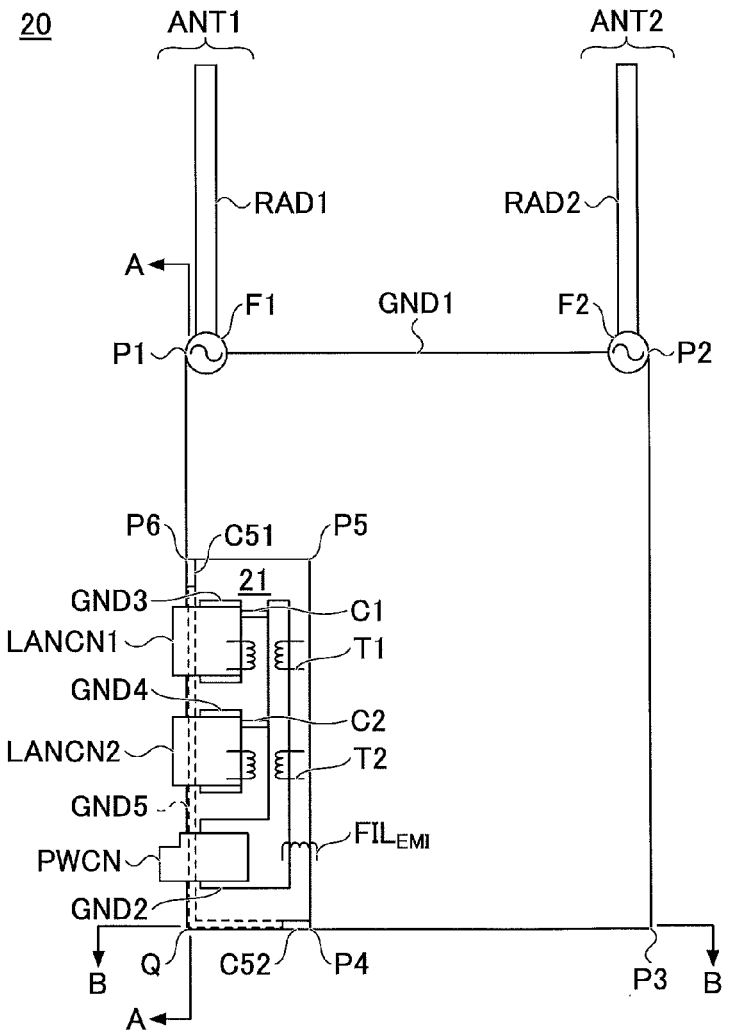
FIGS. 3A through 3C illustrate the radio device according to the embodiment.
Figure 3B:
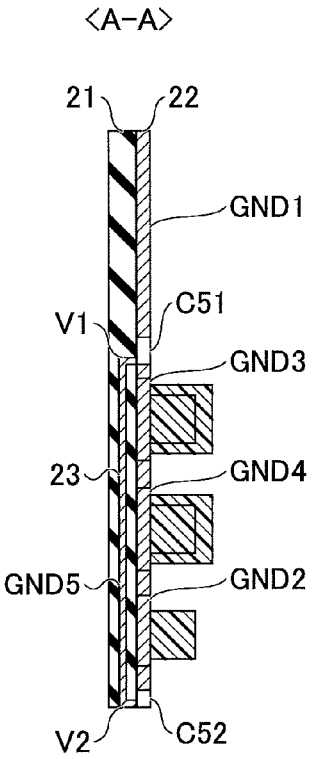
Figure 3C:
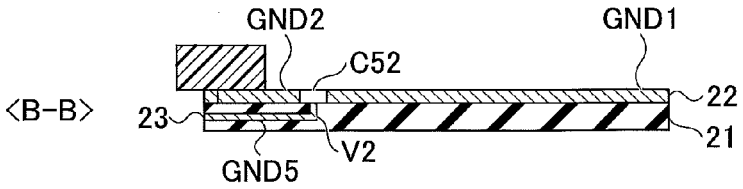

FIG. 3A is a front view of the radio device 20 illustrated in FIG. 2, FIG. 3B is a cross-sectional view cut along a line A-A in FIG. 3A, and FIG. 3C is a cross-sectional view cut along a line B-B in FIG. 3A.

The radio device 20 includes, at least a substrate 21, a main ground GND1, a power source ground GND2, a first connector ground GND3, a second connector ground GND4, an additional ground GND5, a first power feeding unit F1, a second power feeding unit F2, a first radiation element RAD1, a second radiation element RAD2, a first LAN connector LANCN1, a second LAN connector LANCN2, and a power source connector PWCN.

The substrate 21 has a substantially square or rectangular shape, indicated by the point P1, the point P2, the point P3, and the point Q. A line or side connecting the point P1 and the point P2 (P1-P2) and a line or side connecting the point P3 and the point Q (P3-Q) constitute opposite sides. A line may be referred to as a side. A line connecting the point P1 and the point Q (P1-Q) and a line connecting the point P2 and the point P3 (P2-P3) constitute other opposite sides. The line connecting the point P1 and the point P2 is an example of a first edge side. The line connecting the point P3 and the point Q is an example of a second edge side. The line connecting the point P1 and the point Q is an example of a third edge side. The line connecting the point P2 and the point P3 is an example of a fourth edge side.

The main ground GND1 is an example of a ground plane. The main ground GND1 forms a ground on a surface layer 22 formed on the substrate 21. The ground may be referred to as ground plate. The ground may be formed by any appropriate conductive material. Examples of the conductive material are copper (Cu), gold (Au), silver (Ag), and stainless steel; however, the conductive material is not so limited. The substrate 21 includes at least an insulating layer, and the insulating layer may be formed of any type of insulating material. Examples of the insulating material are FR4 (Flame Retardant Type 4) formed of a glass epoxy resin, ceramics, and Teflon (registered trademark).

The main ground GND1 has a shape that is cut out along the point Q to the point P6. The main ground GND1 has an outer periphery or an outline that is formed by a broken line that bends at six points, namely the point P1, the point P2, the point P3, the point P4, the point P5, and the point P6, such that a square or rectangular cutout surrounded by the point P4, the point P5, the point P6, and the point Q is formed. The main ground GND1 has an outer periphery surrounded by six lines, such that a cutout is formed. The shape of the cutout is not limited to one square;

two or more squares may be formed, or the cutout may have any other appropriate shape. For example, the main ground GND1 has an outer periphery (P1-P2, P2-P3, P3-P4, P4-P5, P5-P6, P6-P1) including six or more borderlines connecting two of the adjacent points, such that at least one cutout is formed. The points may be examples of locations where the direction of the outer periphery or outline changes.

The first power feeding unit Fl is provided near the point P1. The first power feeding unit Fl is provided on the side of one end (for example, the corner part) of a line connecting the point P1 and the point P2. The first power feeding unit Fl feeds high frequency signals to the first radiation element RAD1, such that radio signals of a predetermined radio wave may be transmitted/received. The first radiation element RAD1 is connected to the first power feeding unit F1, and extends, from the first power feeding unit F1, away from the main ground GND1 along a line connecting the point Q and the point P1. The length of the first radiation element RAD1 may correspond to, for example, an electric length of approximately $\lambda/4$ (approximately one fourth of a wavelength), where $\lambda$ is the wavelength of the radio wave that is transmitted/received.

The first radiation element RAD1, the first power feeding unit F1, the main ground GND1, and the additional ground GND5 form a first antenna ANT1. The first antenna ANT1 is an example of a first antenna element. The first antenna ANT1 functions as one of the antennas, when the radio device 20 performs communication by a MIMO method with two antennas. The first antenna ANT1 forms a monopole type antenna. The first antenna ANT1 may be a line type antenna, a planar antenna, or a three-dimensional antenna. The main ground GND1 and the additional ground GND5 function so as to form a mirror image of the first radiation element RAD1. A mirror image may be referred to as an image or a shadow image. The length from the first power feeding unit F1 through one end of the additional ground GND5 (the point P6) to the other end of the additional ground GND5 corresponds to greater than or equal to one fourth of the wavelength of the radio wave.

The second power feeding unit F2 is provided near the point P2. The second power feeding unit F2 is provided on the side of the other end (for example, the corner part) of the line connecting the point P1 and the point P2. The second power feeding unit F2 feeds high frequency signals to the second radiation element RAD2, such that radio signals of a predetermined radio wave may be transmitted/received. The second radiation element RAD2 is connected to the second power feeding unit F2, and extends, from the second power feeding unit F2, away from the main ground GND1 along a line connecting the point P3 and the point P2. The length of the second radiation element RAD2 may correspond to, for example, an electric length of approximately $\lambda/4$.

The second radiation element RAD2, the second power feeding unit F2, and the main ground GND1 form a second antenna ANT2. The second antenna ANT2 is an example of a second antenna element. The second antenna ANT2 functions as the other one of the antennas, when the radio device 20 performs communication by a MIMO method with two antennas. The second antenna ANT2 forms a monopole type antenna. The second antenna ANT2 may be a line type antenna, a planar antenna, or a three-dimensional antenna. From the perspective of exerting the same properties by the two antennas, the first antenna ANT1 and the second antenna ANT2 preferably have the same shape and structure. The main ground GND1 functions so as to form a mirror image of the second radiation element RAD2. The length from the second power feeding unit F2 to the point P3 corresponds to an electric length that is longer than one fourth of the wavelength of the radio wave.

As illustrated in FIG. 2, on the substrate 21 in an area of a cutout surrounded by the point P4, the point P5, the point P6, and the point Q, the main ground GND1 is not formed. The area of this cutout includes the power source ground GND2, the first connector ground GND3, the second connector ground GND4, the additional ground GND5, the first LAN connector LANCN1, the second LAN connector LANCN2, and the power source connector PWCN. As illustrated in FIGS. 3A through 3C, the power source ground GND2, the first connector ground GND3, and the second connector ground GND4 are formed on the surface layer 22 formed on the substrate 21. The additional ground GND5 is formed on an inner layer 23 inside the substrate 21.

On the power source ground GND2, the power source connector PWCN is provided. The power source ground GND2 is connected to the main ground GND1 via an EMI filter $FIL_{EMI}$. The EMI filter $FIL_{EMI}$ functions as one type of low-pass filter, and prevents the impact of high frequency Electro Magnetic Interference (EMI) from reaching the inside of the radio device 20.

On the first connector ground GND3, the first LAN connector LANCN1 is provided. When the radio device 20 is used as a small-size cell base station, the radio device 20 performs communication with the core network 11, in addition to performing wireless communication with the user device (for example, the user device 14 of FIG. 1), via the first antenna ANT1 and the second antenna ANT2. The communication with the core network 11 may be performed via a wired interface (for example, the wired interface 16 of FIG. 1). For example, the communication with the core network 11 may be performed via a LAN cable connected to the first LAN connector LANCN1. The first LAN connector LANCN1 has a function of an external interface for a LAN cable, etc. Signals which have been received from a LAN cable, etc., via the first LAN connector LANCN1 flow to the side of a circuit (not illustrated) on the main ground GND1 via a transverter T1. Conversely, signals which have been received from the side of a circuit (not illustrated) on the main ground GND1, flow to the side of the first LAN connector LANCN1 via the transverter T1.

On the second connector ground GND4, the second LAN connector LANCN2 is provided. When the radio device 20 is used as a small-size cell base station, the radio device 20 performs communication with the core network 11, in addition to performing wireless communication with the user device (for example, the user device 14 of FIG. 1), via the first antenna ANT1 and the second antenna ANT2. The communication with the core network 11 may be performed via a wired interface (for example, the wired interface 16 of FIG. 1). For example, the communication with the core network 11 may be performed via a LAN cable connected to the second LAN connector LANCN2. The second LAN connector LANCN2 has a function of an external interface for a LAN cable, etc. Signals which have been received from a LAN cable, etc., via the second LAN connector LANCN2 flow to the side of a circuit (not illustrated) on the power source ground GND2 via a transverter T2. Conversely, signals which have been received from the side of a circuit (not illustrated) on the power source ground GND2, flow to the side of the second LAN connector LANCN2 via the transverter T2.

In the example of FIG. 2, the first LAN connector LANCN1 and the second LAN connector LANCN2 are illustrated; however, the number of LAN connectors is not limited to two. According to the purpose, any appropriate number of LAN connectors may be used. Other than the LAN connector and the power source connector, other elements may be provided in the area of the cutout (the point P4, the point P5, the point P6, the point Q).

Incidentally, when connecting an external device (for example, a cable, an external component, etc.) to the external interface of the radio device 20, there are standards such as a safety standard for the external device. For example, when a LAN cable is connected to one of or both of the first LAN connector LANCN1 and the second LAN connector LANCN2, there is a safety standard relevant to the breakdown voltage of the LAN cable. For example, the safety standard is UL60950-1. For example, the safety standard is defined to assure that dielectric breakdown does not occur when a voltage of less than a predetermined value is applied to the part of the insulating body. For example, in the case of UL60950-1, the breakdown voltage is 1500 volts.

In order to secure or assure such a breakdown voltage, the area of the cutout (the point P4, the point P5, the point P6, the point Q) is formed in the main ground GND1, the main ground GND1. In addition, the first connector ground GND3, and the second connector ground GND4, are physically detached. A structure in which the grounds are detached, may be referred to as an island GND structure. The transverter T1 is provided between the first LAN connector LANCN1 and a circuit (not illustrated) on the main ground GND1, such that signals may be transmitted/received, and the breakdown voltage is secured. A capacitor C1 is provided between the first connector ground GND3 and the power source ground GND2, such that the breakdown voltage is secured.

Similarly, the transverter T2 is provided between the second LAN connector LANCN2 and a circuit (not illustrated) on the main ground GND1, such that signals may be transmitted/received, and the breakdown voltage is secured. A capacitor C2 is provided between the second connector ground GND4 and the power source ground GND2, such that the breakdown voltage is secured.

Between the first connector ground GND3 and the additional ground GND5, and between the second connector ground GND4 and the additional ground GND5, the breakdown voltage may or may not be secured. However, as described below, the additional ground GND5 and the main ground GND1 are connected such that high frequency signals may flow, and therefore it is preferable that the breakdown voltage is secured at least for the main ground GND1. Thus, for example, a capacitor C51 is provided between the main ground GND1 and the additional ground GND5, by which predetermined high frequency signals may pass and the breakdown voltage is secured between the main ground GND1 and the additional ground GND5.

Note that it is not essential to provide a capacitor such as the capacitor C1, C2, C51, etc., between two elements, in order to secure the breakdown voltage between the two elements. For example, instead of or in addition to providing a capacitor between the two elements, by physically spacing apart the two elements by a long distance, the breakdown voltage may be secured between the two elements without a capacitor. An example of not using a capacitor is described below.

As illustrated in FIG. 2, it is preferable to form an area of a cutout (the point P4, the point P5, the point P6, the point Q) in the main ground GND1, from the perspective of securing the breakdown voltage with respect to the first LAN connector LANCN1 and the second LAN connector LANCN2. However, when the area of a cutout (the point P4, the point P5, the point P6, the point Q) is formed, the area of the main ground GND1 on the side of the first antenna ANT1 becomes small. For example, when a cutout is not formed, the length of the main ground GND1 on the side of the first antenna ANT1 is from the point P1 to the point Q; however, when a cutout is formed, this length is from the point P1 to the point P6. From the perspective of making the first antenna ANT1 operate appropriately as a half-wavelength dipole antenna, a mirror image of the first radiation element RAD1 having an electric length of approximately one fourth of a wavelength, is preferably appropriately formed between the point P1 and the point P6 in the main ground GND1.

When the frequency of the radio waves that are transmitted/received is high, the length of approximately one fourth of a wavelength is short, and therefore even when a cutout is formed in the main ground GND1, it is easy to secure a length of approximately one fourth of a wavelength or more between the point P1 and the point P6. For example, when the frequency of the radio wave is approximately 5 GHz, the length of one fourth of a wavelength is approximately 15 mm, and therefore a length corresponding to a short electric length of approximately 15 mm is to be secured between the point P1 and the point P6.

Meanwhile, from the perspective of facilitating the reach of radio waves (facilitating the radio waves to perform communications), and that a wide range where communication is possible is already secured by existing equipment, it is preferable to use a relatively low frequency in a frequency band of, for example, approximately 700 Mhz through approximately 900 Mhz. A frequency band of approximately 700 Mhz through approximately 900 Mhz may be referred to as a so-called platinum band.

For example, in the case of a frequency band of approximately 700 Mhz that belongs to the platinum band, the length of one fourth of a wavelength is long, such as approximately 110 mm. Therefore, when a cutout is formed in the main ground GND1, the length between the point P1 and the point P6 may not reach an electric length of one fourth of a wavelength. When the length between the point P1 and the point P6 does not reach an electric length of one fourth of a wavelength, a mirror image of the first radiation element RAD1 having an electric length of one fourth of a wavelength is not appropriately formed, and a failure may occur in the operation of a half-wavelength dipole antenna. Therefore, as the frequency of the radio waves becomes lower (the longer the wavelength), it may become more difficult to secure a main ground GND1 having an appropriate size for both the first antenna ANT1 and the second antenna ANT2.

The MIMO method of using a plurality of antennas such as the first antenna ANT1 and the second antenna ANT2, is preferable from the perspective of enhancing high speed and high quality of wireless communication. Each of the plurality of antennas individually transmits/receives radio waves. Therefore, from the perspective of enhancing high speed and high quality of the entire system, not only is it preferable that are the properties of each of the plurality of antennas are favorable, but it is also preferable that the properties of the plurality of antennas are substantially the same favorable level. However, when a ground of an appropriate shape is not secured, the properties of the antennas that are affected by the shape of the ground are degraded, and therefore the high speed and high quality by the MIMO method may not be sufficiently enjoyed.

In the example of FIG. 2, for example, the length between the point P1 and the point Q (or between the point P2 and the point P3) is approximately 140 mm, the length between the point P4 and the point Q (or between the point P5 and the point P6) is approximately 20 mm, and the length between the point P1 and the point P6 is approximately 60 mm. The length between the point P1 and the point Q (approximately 60 mm) is shorter than (only approximately half of) the length of one fourth of a wavelength (approximately 110 mm) when transmitting/receiving radio waves of approximately 700 MHz, and therefore the properties of the first antenna ANT1 may be degraded. On the side of the second antenna ANT2, no cutouts are formed, and therefore such properties are not degraded. Therefore, unless some device is provided such as the additional ground GND5 as described below, the first antenna ANT1 and the second antenna ANT2 will have an inferior-to-superior relationship or a deviation, and therefore the benefits of the MIMO method may not be sufficiently enjoyed.

3. Additional Ground GND5

As illustrated in FIG. 2, in the substrate 21 in the area where the main ground GND1 is cut out, an additional ground GND5 is provided, which has an L shape connecting the point P6, the point Q, and the point P4. The additional ground GND5 is an example of a ground element. As illustrated in FIGS. 3A through 3C, the additional ground GND5 is formed in the inner layer 23 inside the substrate 21.

Figure 4A:
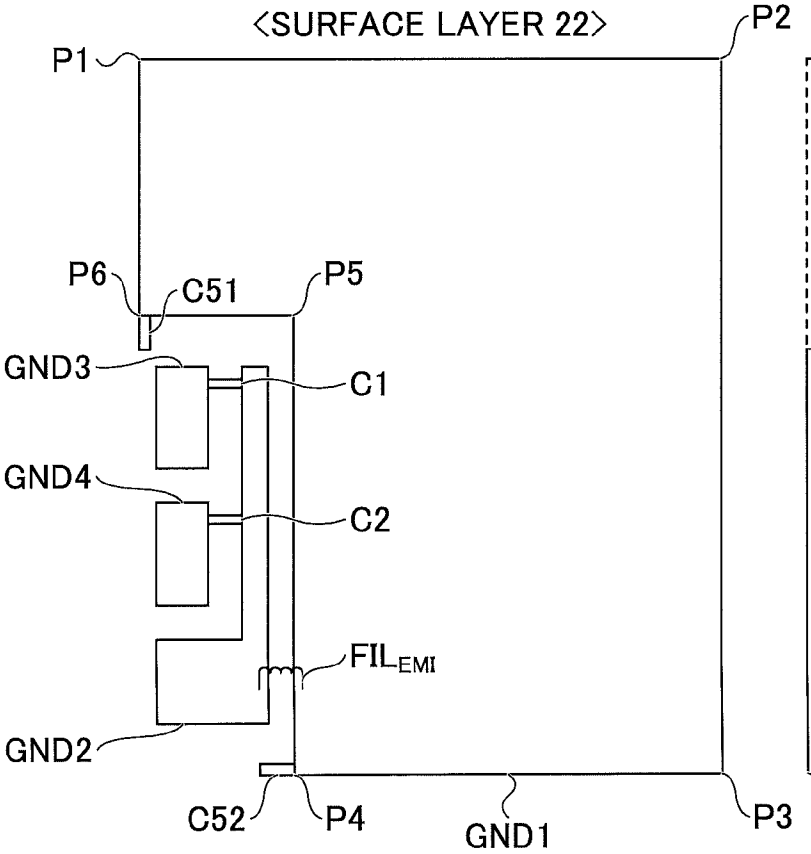
FIG. 4A illustrates a pattern of a conductive material formed on a surface layer.
Figure 4B:
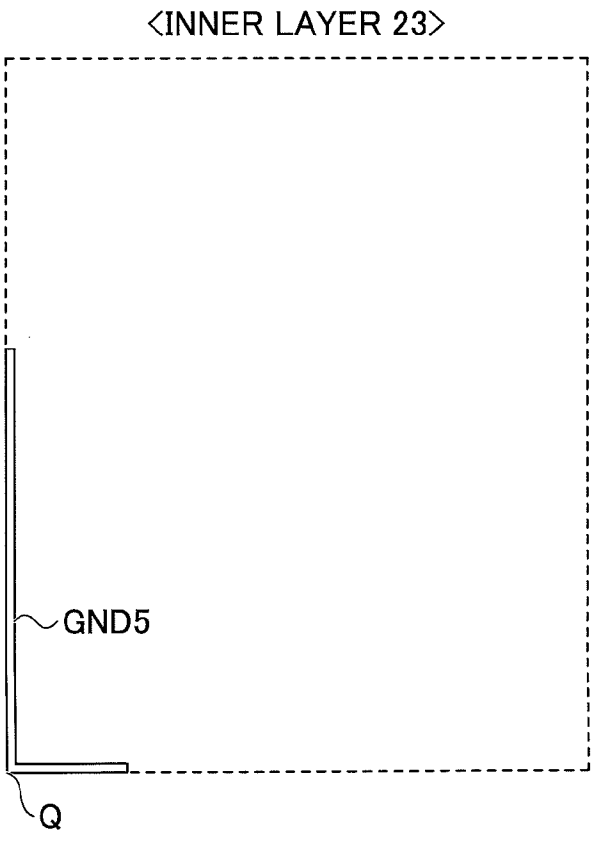
FIG. 4B illustrates a pattern of a conductive material formed on an inner layer.

FIG. 4A illustrates the main ground GND1, the power source ground GND2, the first connector ground GND3, and the second connector ground GND4, which are formed on the surface layer 22. FIG. 4B illustrates the additional ground GND5 formed on the inner layer 23. The additional ground GND5 may be formed of any appropriate conductive material. Examples of the conductive material are copper (Cu), gold (Au), silver (Ag), and stainless steel; however, the conductive material is not so limited.

The shape of the additional ground GND5 may be expressed by one or more lines, or by one or more border lines connecting two adjacent the points. In this case, for example, when the additional ground GND5 has a path that extends from one end to another end, the additional ground GND5 may correspond to one end, the other end, and a location where the direction of the path changes between the two ends.

As illustrated in FIGS. 3A through 4B, one end of the additional ground GND5 is connected to the main ground GND1 at the point P6 via a first via V1 (FIG. 3B) and the capacitor C51 (FIG. 2, FIG. 3A, FIG. 3B, and FIG. 4A). The other end of the additional ground GND5 is connected to the main ground GND1 at the point P4 via a second via V2 (FIGS. 3A and 3B) and a capacitor C52 (FIG. 2, FIGS. 3A through 3C, and FIG. 4A).

The capacitor C51 allows the passage of signals of a frequency band of radio waves that are transmitted/received by the first antenna ANT1 and the second antenna ANT2, and is selected to have a desired dielectric strength. The frequency of radio waves that are transmitted and received may belong to any appropriate frequency band, such as the so-called platinum band extending in a range of, for example, approximately 700 Mhz through approximately 900 Mhz. The capacitor C51 is selected such that the frequency band of the radio waves that are transmitted/received is passed, and therefore, for the first antenna ANT1, not only the main ground GND1, but also the additional ground GND5 functions as a ground. Not only the part of the main ground GND1 from the point P1 to the point P6, but also the additional ground GND5 contributes to forming a mirror image of the first radiation element RAD1, and is relevant to the operation of the first antenna ANT1. Therefore, even when the part of the main ground GND1 from the point P1 to the point P6 corresponds to an electric length that is shorter than approximately one fourth of a wavelength, if the total length of the part of the main ground GND1 from the point P1 to the point P6 and the additional ground GND5 corresponds to an electric length that is greater than or equal to approximately one fourth of a wavelength, it is possible to appropriately form a mirror image of the first radiation element RAD1. By providing the additional ground GND5, it is possible to appropriately compensate for the degrading of properties of the first antenna ANT1, which may occur due to the cutout.

The capacitor C51 is selected to have a desired dielectric strength. The desired dielectric strength is, for example, greater than or equal to 1500 volts, in the case of the safety standard of UL60950-1 described above with regard to a LAN cable. The transverter T1 is provided between the first LAN connector LANCN1 and the circuit (not illustrated) on the main ground GND1, such that signals may be transmitted/received and the breakdown voltage is secured. The capacitor C1 is provided between the first connector ground GND3 and the power source ground GND2, such that the breakdown voltage is secured.

Between the first connector ground GND3 and the additional ground GND5, the breakdown voltage may be secured or may not be secured. However, the additional ground GND5 and the main ground GND1 are connected at the point P6 such that high frequency signals flow, and therefore it is preferable to secure the breakdown voltage at least for the main ground GND1. In addition to, or instead of securing the breakdown voltage between the main ground GND1 and the additional ground GND5, the breakdown voltage may be secured between the first connector ground GND3 and the additional ground GND5. In the examples of FIG. 2 through 4B, the capacitor C51 is provided between the main ground GND1 and the additional ground GND5, such that predetermined high frequency signals are passed and the breakdown voltage is secured.

In order to secure the breakdown voltage between two elements, for example, a capacitor having a withstand voltage may be provided between the two elements. Alternatively, in order to secure the breakdown voltage between two elements, the two elements may be physically spaced apart by a long distance. Alternatively, a capacitor having such a breakdown voltage may be provided between the two elements. Alternatively, in order to secure the breakdown voltage between two elements, in addition to inserting a capacitor between the two elements, the two elements may be physically spaced apart by a long distance. From the perspective of reducing size, it is preferable to insert a capacitor.

In the examples of FIG. 2 through 4B, the additional ground GND5 is connected to the main ground GND1 not only at one end (the point P6) but also the other end (the point P4). The other end of the additional ground GND5 is connected to the main ground GND1 at the point P4, via the second via V2 and the capacitor C52. Similar to the capacitor C51, the capacitor C52 may also be selected so as to pass the frequency band of the radio waves that are transmitted/received and to have a desired dielectric strength.

From the perspective of appropriately forming a mirror image of the first radiation element RAD1 of the first antenna ANT1, at least one end of the additional ground GND5 is preferably connected to a line connecting the point P5 and the point P6 of the main ground GND1 (P5-P6). That is to say, at least one end of the additional ground GND5 is connected to a border line (P5-P6) having the shorter path length along the outer periphery to the first power feeding unit F1, among two or more border lines (P4-P5; P5-P6) forming at least part of the cutout.

Meanwhile, the other end of the additional ground GND5 may or may not be connected to the main ground GND1. This is because it is considered that the part between the point P3 and the point P4 of the main ground GND1 does not significantly affect the forming of the mirror image of the first antenna ANT1 and the second antenna ANT2. However, as illustrated in FIG. 2, when both ends of the additional ground GND5 are connected to the main ground GND1 so as to surround the area of a cutout (the point P4, the point P5, the point P6, the point Q), the electromagnetic shielding effect is enhanced, and therefore it is preferable to surround the cutout area from the perspective of EMI countermeasures.

4. Modification Examples 4-1. First Modification Example

In the examples of FIGS. 2 through 4B, the additional ground GND5 is formed on the inner layer 23 below the surface layer 22 on which the main ground GND1 is formed, and both ends of the additional ground GND5 are respectively connected to the main ground GND1 via the capacitor C51 and the capacitor C52. The additional ground GND5 may be formed on the inner layer 23 as illustrated in FIGS. 2 through 4B, or may be formed on the surface layer 22 on which the main ground GND1 is formed, although not illustrated. The additional ground GND5 and the main ground GND1 may be connected by the capacitor C51 and the capacitor C52 as illustrated in FIGS. 2 through 4B, or may be connected without such capacitors. The structure including the additional ground GND5 may have various configurations.

A specific configuration of the additional ground GND5 is preferably determined so as to satisfy a predetermined condition, such as the dielectric strength. For example, as illustrated in FIG. 2, when the radio device 20 is provided with the first LAN connector LANCN1 and the second LAN connector LANCN2, at least three conditions are preferably satisfied. The first condition is that signals of a desired frequency band flow through the main ground GND1 and the additional ground GND5. The second condition is that the dielectric strength is secured between the main ground GND1, the power source ground GND2, the second connector ground GND4, and the first connector ground GND3. The third condition is that the dielectric strength is secured between the main ground GND1, the power source ground GND2, the first connector ground GND3, and the second connector ground GND4.

Figure 5:
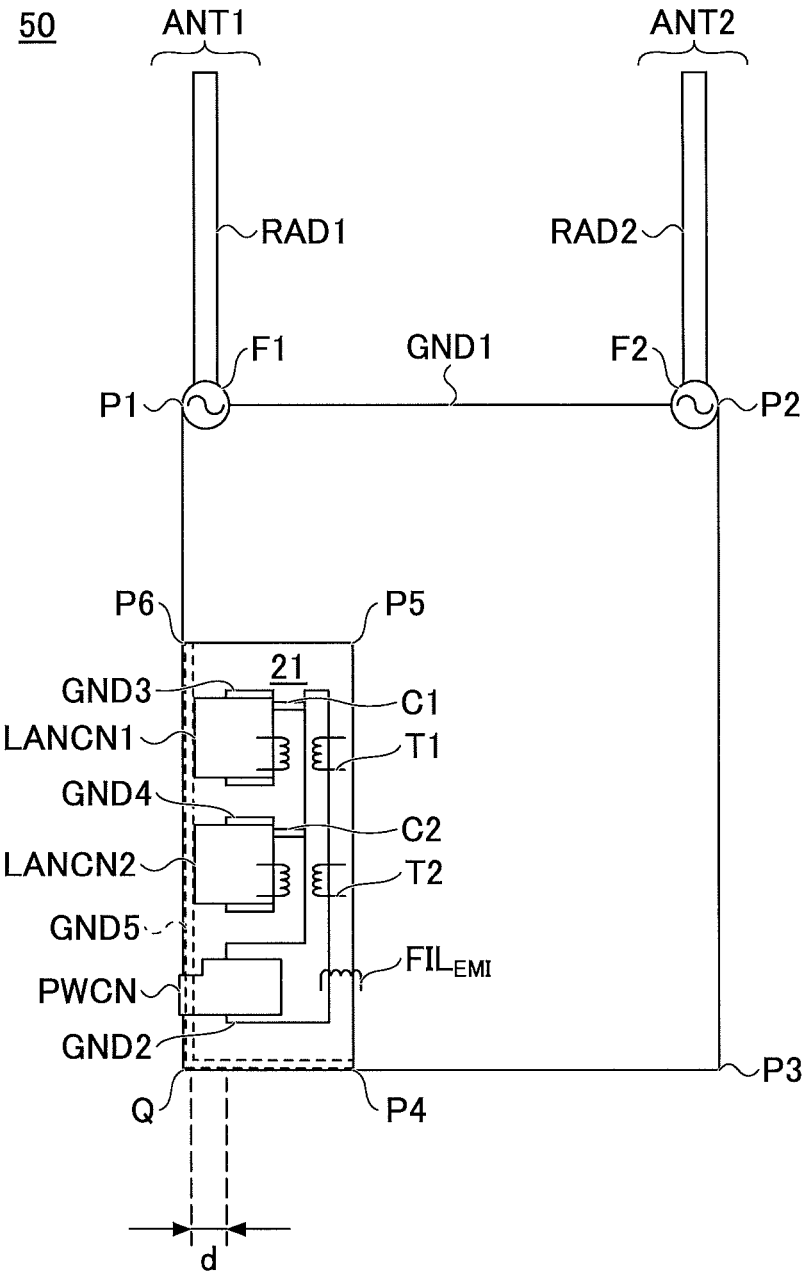
FIG. 5 illustrates a radio device according to a modification example, in which an additional ground GND5 is directly connected to a main ground GND1 without using a capacitor.

FIG. 5 illustrates a radio device 50 according to a modification example, in which one end of the additional ground GND5 is directly connected to the main ground GND1 without using a capacitor. Also in a case where the main ground GND1 and the additional ground GND5 are connected without using a capacitor, it is preferable to secure the breakdown voltage at least between the main ground GND1 and the first connector ground GND3. The main ground GND1 and the first connector ground GND3 are sufficiently spaced apart such that the breakdown voltage is secured. In the example of FIG. 5, a capacitor for securing the breakdown voltage is not provided between the main ground GND1 and the additional ground GND5, and therefore it is preferable to secure the breakdown voltage between the first connector ground GND3 and the additional ground GND5. In the example of FIG. 5, the additional ground GND5 is sufficiently physically spaced apart from the first connector ground GND3 by a distance d, such that the breakdown voltage is secured between the first connector ground GND3 and the additional ground GND5. For example, d is approximately greater than or equal to 1 mm. Similarly, the additional ground GND5 is sufficiently physically spaced apart from the second connector ground GND4 by a distance d, such that the breakdown voltage is secured between the second connector ground GND4 and the additional ground GND5. For example, d is approximately greater than or equal to 1 mm. Note that the additional ground GND5 may be formed on the inner layer 23 lower than the surface layer 22 as illustrated in FIG. 5, or may be formed on the surface layer 22, although not illustrated.

Note that in order to secure the breakdown voltage, it is possible to use one of or both of the methods of (1) using a capacitor as illustrated in FIGS. 2, and (2) spacing apart the elements as illustrated in FIG. 5.

In the example of FIG. 5, one end of the additional ground GND5 is connected to the main ground GND1 at the point P6, and in addition, the other end of the additional ground GND5 is directly connected to the main ground GND1 at the point P4 without using a capacitor. One end of the additional ground GND5 is connected to the main ground GND1 at the point P6; however, the other end of the additional ground GND5 may or may not be connected to the main ground GND1 at the point P4. However, as illustrated in FIG. 5, when both ends of the additional ground GND5 are connected to the main ground GND1 so as to surround the area of a cutout (the point P4, the point P5, the point P6, the point Q), the electromagnetic shielding effect is enhanced, and therefore it is preferable to surround the cutout area from the perspective of EMI countermeasures.

4-2. Second Modification Example

Figure 6:
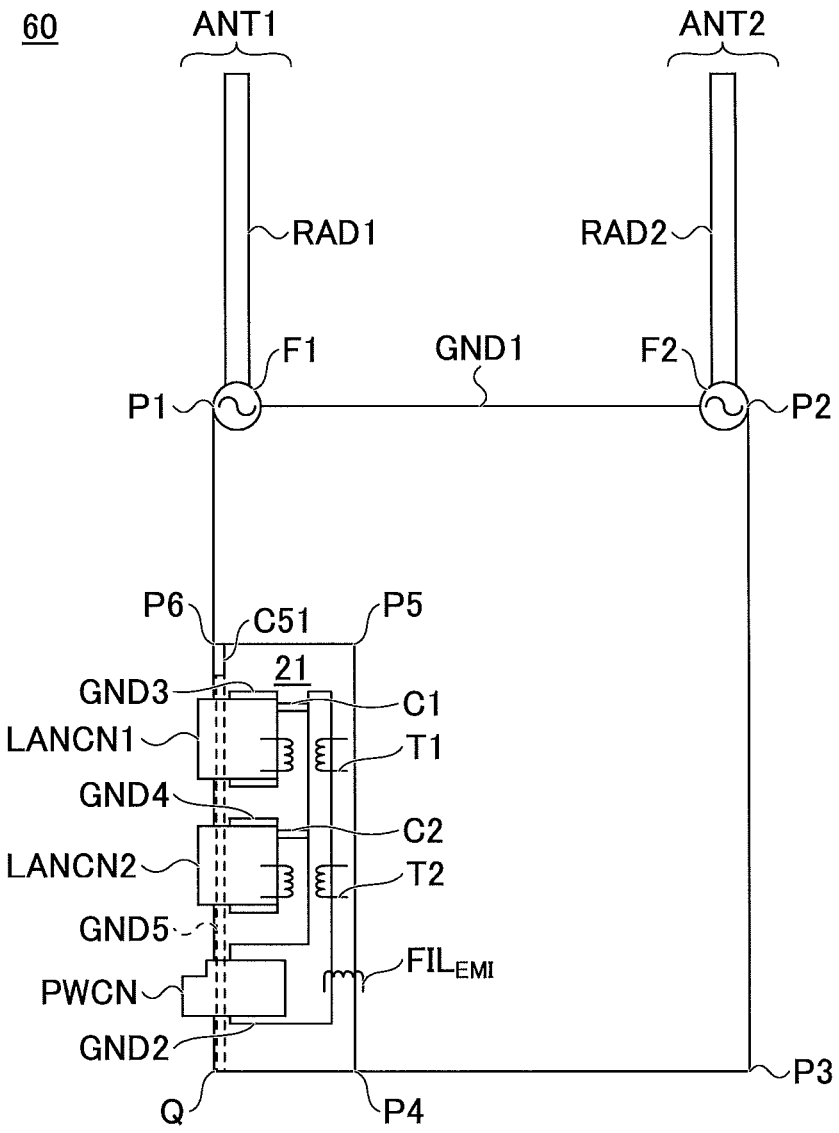
FIG. 6 illustrates a radio device according to a modification example in which the additional ground GND5 has a shape that extends linearly.

FIG. 6 illustrates a radio device 60 according to a modification example in which the additional ground GND5 has a shape that extends linearly. As mentioned with respect to the examples illustrated in FIGS. 2 through 5, from the perspective of appropriately forming a mirror image with respect to the first radiation element RAD1, the other end of the additional ground GND5 need not be connected to the main ground GND1 at the point P4. In the example of FIG. 6, one end of the additional ground GND5 corresponds to the point P6, and the other end of the additional ground GND5 corresponds to the point Q. Furthermore, when the total length, which extends from the point P1 through one end P6 of the additional ground GND5 to the other end of the additional ground GND5, corresponds to the electric length of greater than or equal to one fourth of a wavelength, the other end of the additional ground GND5 does not need to reach the point Q.

Figure 7:
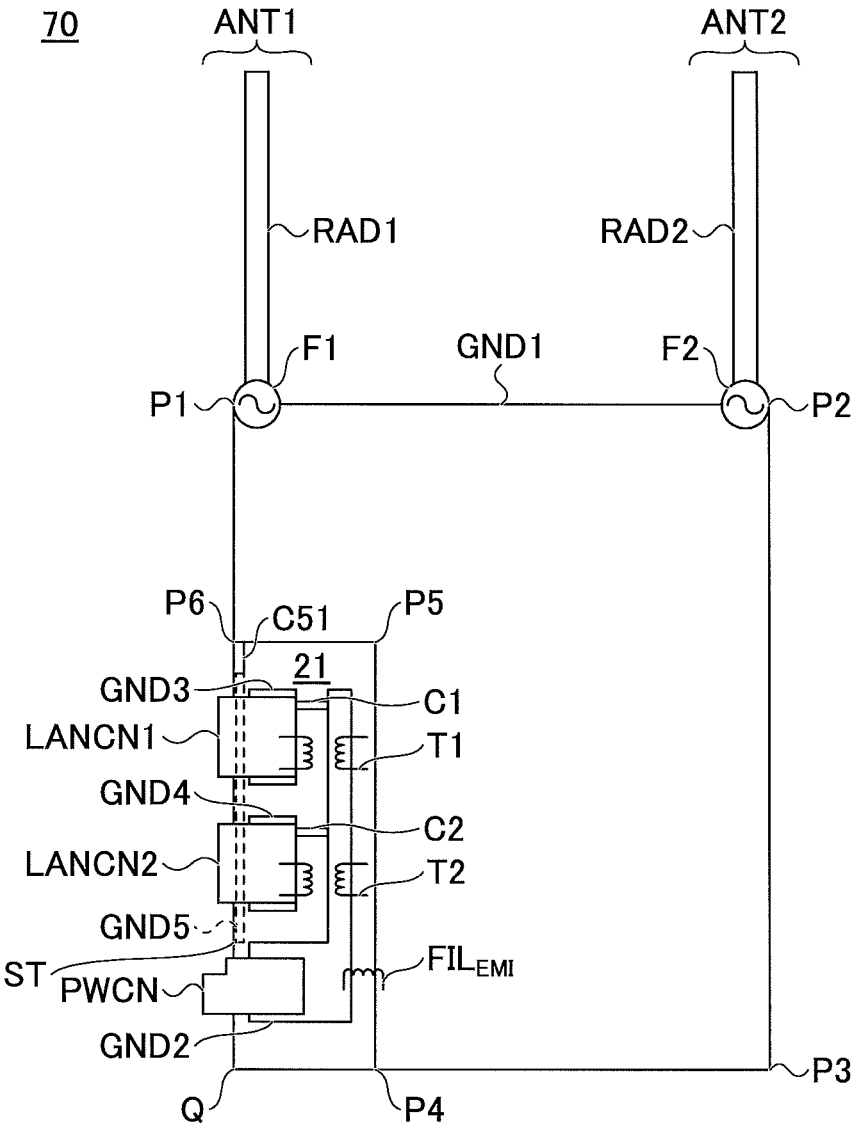
FIG. 7 illustrates a radio device according to another modification example in which the additional ground GND5 has a shape that extends linearly.

FIG. 7 illustrates a radio device 70 according to another modification example in which the additional ground GND5 has a shape that extends linearly. In the example of FIG. 7, the other end of the additional ground GND5 does not reach the point Q. In the example of FIG. 7, the additional ground GND5 extends from the point P1 toward the point Q, but only reaches the point ST. In order to appropriately form a mirror image with respect to the first radiation element RAD1, the additional ground GND5 may not only be shaped as illustrated in FIGS. 2 through 5, but may be shaped as illustrated in FIG. 6, and may be shaped as illustrated in FIG. 7.

The additional ground GND5 may have a linear shape or a shape of a broken line. The additional ground GND5 may be formed on the inner layer 23, or may be formed on the surface layer 22. Although not illustrated, the additional ground GND5 may have a meandering shape or an undulating shape having a part formed on the inner layer 23 and a part formed on the surface layer 22.

4-3. Third Modification Example

In the radio devices illustrated in FIGS. 2 through 7, a cutout is formed in the part surrounded by the point P4, the point P5, the point P6, and the point Q in the main ground GND1 having a rectangular shape with a long side of approximately 140 mm, and three connectors are accommodated. The location of accommodating such connectors may be considered to be between the point P1 and the point P2 from the perspective of the size of the connector. However, the part between the point P1 and the point P2 is near the first antenna ANT1 and the second antenna ANT2, and is thus apt to significantly affect the properties (for example, the gain and directivity) of the first antenna ANT1 and the second antenna ANT2. Therefore, the connector for a LAN cable, etc., is preferably not disposed between the point P1 and the point P2.

In the examples illustrated in FIGS. 2 through 7, the shape of the cutout surrounded by the point P4, the point P5, the point P6, and the point Q is a rectangle having a long side corresponding to the side P4-P5 and a short side corresponding to the side P5-P6. From the perspective of size in accommodating the connector, the cutout may be formed in a rectangular area having a short side corresponding to the side P4-P5 and a long side corresponding to the side P5-P6. However, when the area for accommodating the connector is a rectangular area having a short side corresponding to the side P4-P5 and a long side corresponding to the side P5-P6, the cutout may not only affect the first antenna ANT1 but also the second antenna ANT2. Therefore, it is not preferable to reverse the relationship of the length of long side and the length of short side of the rectangular shape of the cutout illustrated in FIG. 2, from the perspective that the properties of both the first antenna ANT1 and the second antenna ANT2 may be degraded.

In the embodiment, as illustrated in FIGS. 2 through 7, by making the cutout for accommodating the connector affect only one of the antennas (first antenna ANT1), it is possible to maintain favorable properties of the other antenna (second antenna ANT2). As for the antenna that is affected by the cutout, the degradation of properties may be alleviated by providing the additional ground GND5 in the area of the cutout. Therefore, when the number of connectors to be accommodated in the radio device 20 is less than a predetermined number, it is preferable to make the cutout affect only one of the antennas (which is the first antenna ANT1 in the examples of FIGS. 2 through 7, but may be the second antenna ANT2). Alternatively, when the cutout needed for accommodating one or more components is relatively small, it is preferable to make the cutout affect only one of the antennas.

However, the number and type of accommodated components (for example, the connector) are not illustrated to the examples illustrated in FIG. 2, etc., and any appropriate number and type of components may be included in the radio device.

Therefore, depending on the number and type of accommodated components (for example, the connector), it may be difficult to make the cutout affect only one of the antennas (first antenna ANT1). An example for handling such a difficulty is described below.

Figure 8:
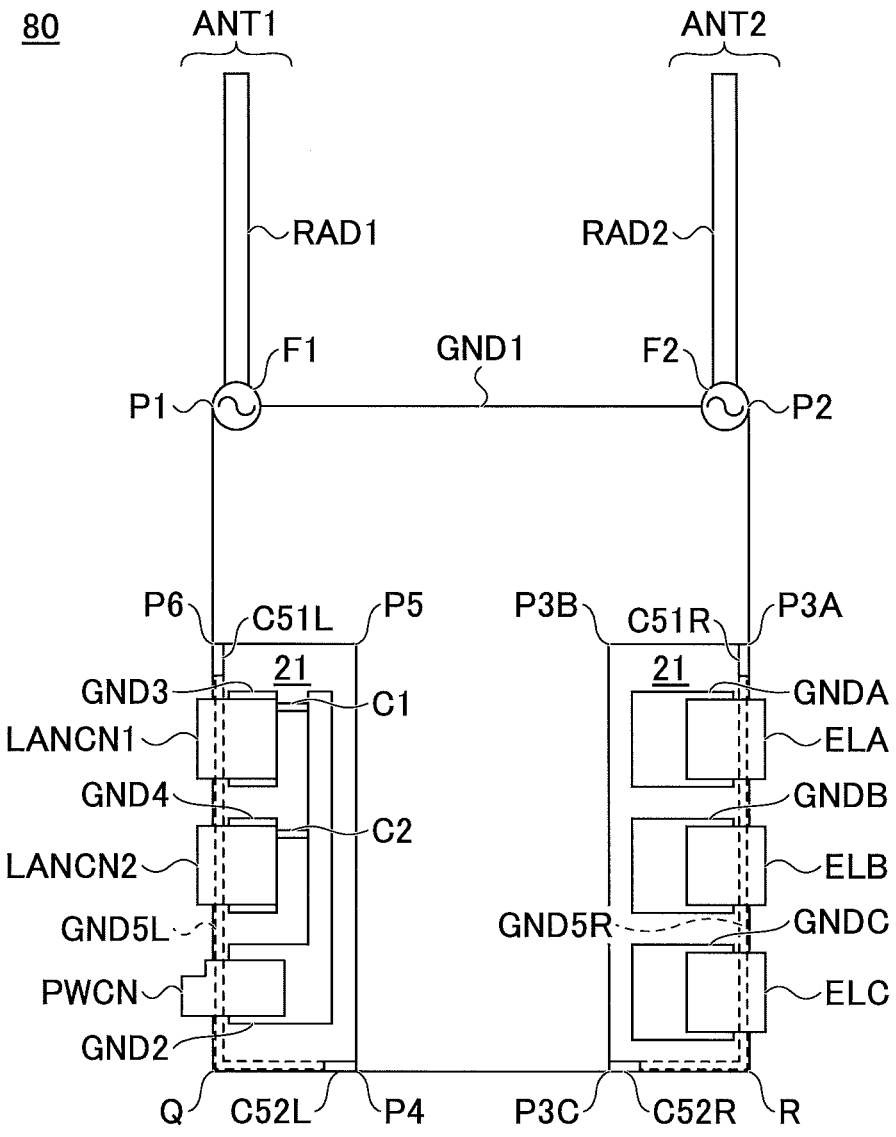
FIG. 8 illustrates a radio device according to a modification example, in which two cutouts are formed symmetrically.

FIG. 8 illustrates a radio device 80 according to a modification example, in which cutouts are formed at two locations having a symmetrical positional relationship and components are accommodated. The radio device 80 includes the same elements as those included in the radio device 20, and the same elements are denoted by the same reference numerals. As for the reference numerals of the capacitors C51, C52, and the additional ground GND5, the elements on the side of the first antenna ANT1 are accompanied by "L" (C51L, C52L, GND5L), and the elements on the side of the second antenna ANT2 are accompanied by "R" (C51R, C52R, GND5R). The transverters T1, T2 and the EMI filter $FIL_{EMI}$ are actually included, but are not illustrated in FIG. 8 as a matter of simplification. The radio device 80 includes, in addition to the elements included in the radio device 20, at least ground elements GNDA, GNDB, GNDC, elements ELA, ELB, ELC, and an additional ground GND5R.

Cutouts are formed on both the left and right side surfaces of the radio device 80. The main ground GND1 formed on the substrate 21 is cut out along a line extending from a corner part R to the point P3A of the substrate 21, and is cut out along a line extending from a corner part Q to the point P6 of the substrate 21. In the main ground GND1, a rectangular cutout surrounded by the point P3A, the point P3B, the point P3C, and the point R is formed; and a rectangular cutout surrounded by the point P4, the point P5, the point P6, and the point Q is formed. The main ground GND1 has an outer periphery or an outline that is formed by a broken line that bends at eight the points of the point P1, the point P2, the point P3A, the point P3B, the point P3C, the point P4, the point P5, and the point P6.

The radio device 80 illustrated in FIG. 8 includes, on the substrate 21 in an area of a cutout on the left side surrounded by the point P4, the point P5, the point P6, and the point Q, three connectors (power source connector PWCN, first LAN connector LANCN1, and second LAN connector LANCN2), and the additional ground GND5L. The radio device 80 includes, on the substrate 21 in an area of a cutout on the right side surrounded by the point P3 The point P3B, the point P3C, and the point R, three grounds (GNDA, GNDB, GNDC), three elements (ELA, ELB, ELC), and the additional ground GND5R. The three elements may be connectors or elements that exert functions other than that of a connector. In FIG. 8, the element ELA is provided on the ground GNDA, the element ELB is provided on the ground GNDB, and the element ELC is provided on the ground GNDC; however, this is merely one example, and the elements may be arranged in any appropriate manner. The additional ground GND5R may have equal functions with those of the additional ground GND5L on the left side. It is not essential to form the areas of cutouts on the left and right in a symmetrical manner, or to form the additional ground GND5L and the additional ground GND5R on the left and right in a symmetrical manner; however, it is preferable to form these in a symmetrical manner from the perspective of making the first antenna ANT1 and the second antenna ANT2 have the same properties.

4-4. Fourth Modification Example

Figure 9:
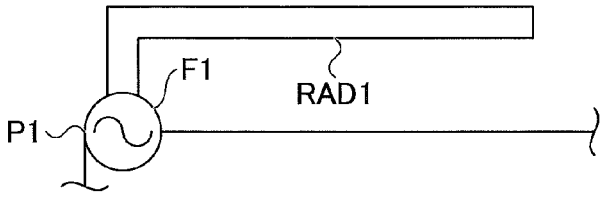
FIG. 9 illustrates an example of a monopole type antenna formed by an L shaped antenna.
Figure 10:
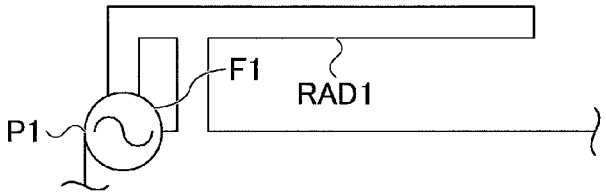
FIG. 10 illustrates an example of a monopole type antenna formed by a reversed F type antenna.
Figure 11:
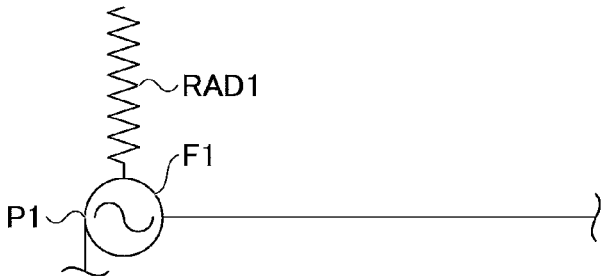
FIG. 11 illustrates an example of a monopole type antenna formed by a helical shape antenna.
Figure 12:
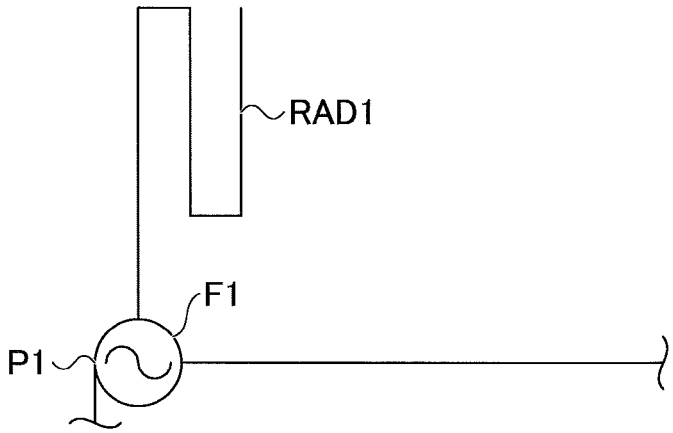
FIG. 12 illustrates an example of a monopole type antenna formed by a vertical meandering antenna.
Figure 13:
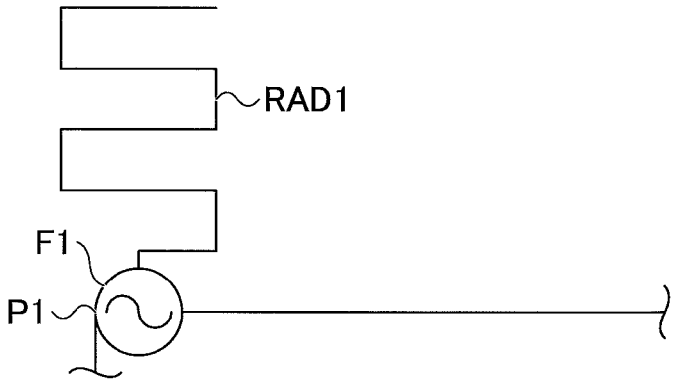
FIG. 13 illustrates an example of a monopole type antenna formed by a horizontal meandering antenna.

The first antenna ANT1 and the second antenna ANT2 illustrated in FIGS. 2 through 8 may be, for example, monopole type antennas. For example, a monopole type antenna may be an L shaped antenna as illustrated in FIG. 9. FIG. 9 illustrates a part of the first antenna ANT1; however, a part of the second antenna ANT2 may have the same structure as that of the first antenna ANT1 (hereinafter, the same applies to FIGS. 10 through 13). Furthermore, the monopole type antenna may be a reversed F type antenna (FIG. 10), a helical shape antenna (FIG. 11), a vertical meandering antenna (FIG. 12), and a horizontal meandering antenna (FIG. 13); although the antenna is not so limited.

5. Simulation Results

A description is given of simulation results of a radio device that does not include the additional ground GND5 (referred to as "reference example"), the radio device illustrated in FIG. 2 (referred to as "L shaped GND5 structure"), and the radio device illustrated in FIG. 6 (referred to as "linear shaped GND5 structure").

Figure 14:
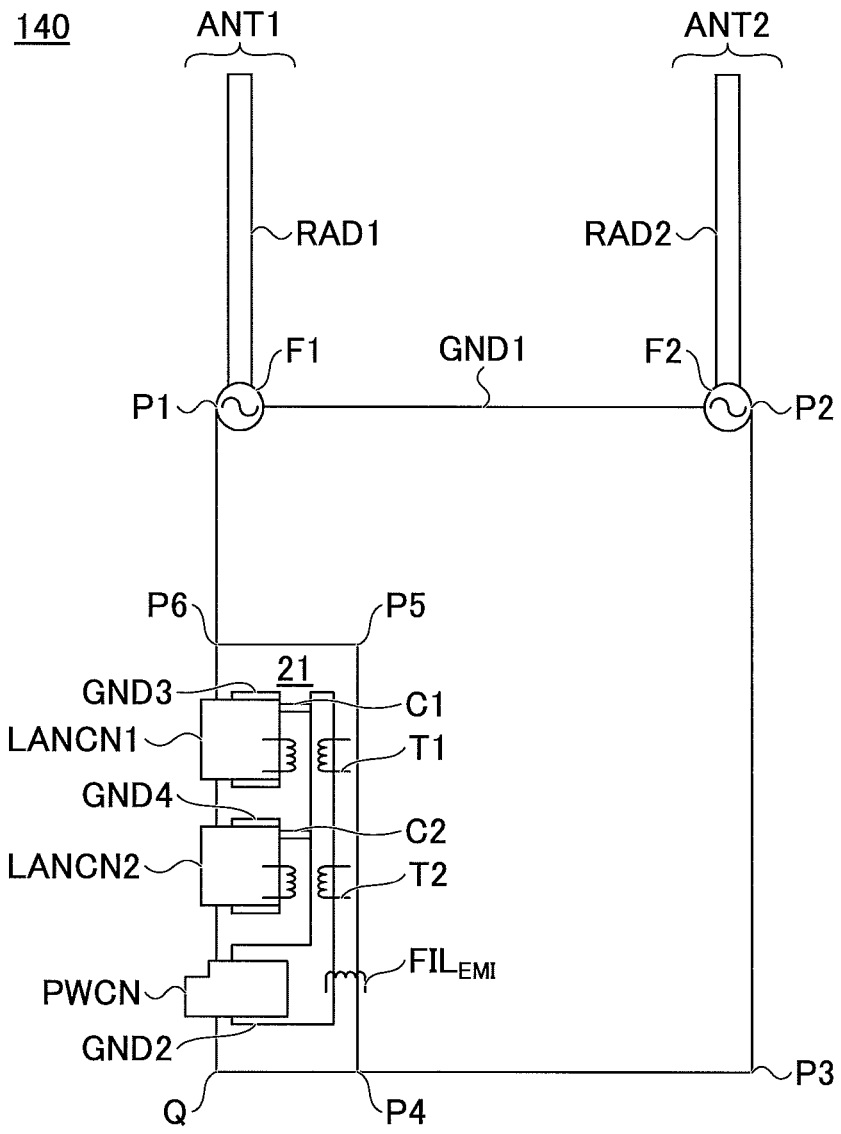
FIG. 14 illustrates a radio device of a reference example.

FIG. 14 illustrates a radio device 140 of the reference example. Unlike the examples illustrated in FIGS. 2 through 8, the radio device 140 does not include the additional ground GND5.

Figure 15:
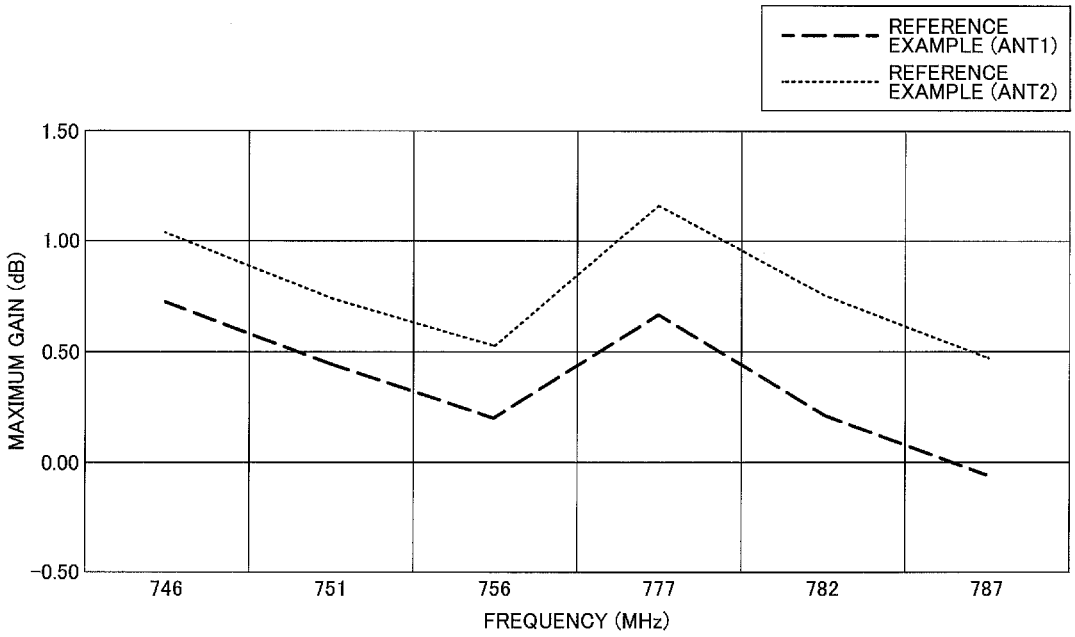
FIG. 15 illustrates the frequency dependence of the maximum gain in the 700 MHz band, with respect to the two antennas (ANT1, ANT2) in the reference example.

FIG. 15 illustrates the frequency dependence of the maximum gain in the 700 MHz band, with respect to the two antennas (ANT1, ANT2) in the reference example. The maximum gain is the maximum radiation power in a case where an isotropic antenna is the standard. It is not essential to evaluate the properties of the antenna by the maximum gain. The properties of the antenna may be evaluated by any appropriate standard. The maximum gain of the first antenna ANT1 has degraded, in the 700 MHz band, by more than approximately 0.25 dB through approximately 0.5 dB, than the maximum gain of the second antenna ANT2. The reason why such an inferior-to-superior relationship has occurred in the maximum gain is that, as illustrated in FIG. 14, there is a cutout formed in the main ground GND1 on the side of the first antenna ANT1, but a cutout is not formed on the side of the second antenna ANT2.

Figure 16:
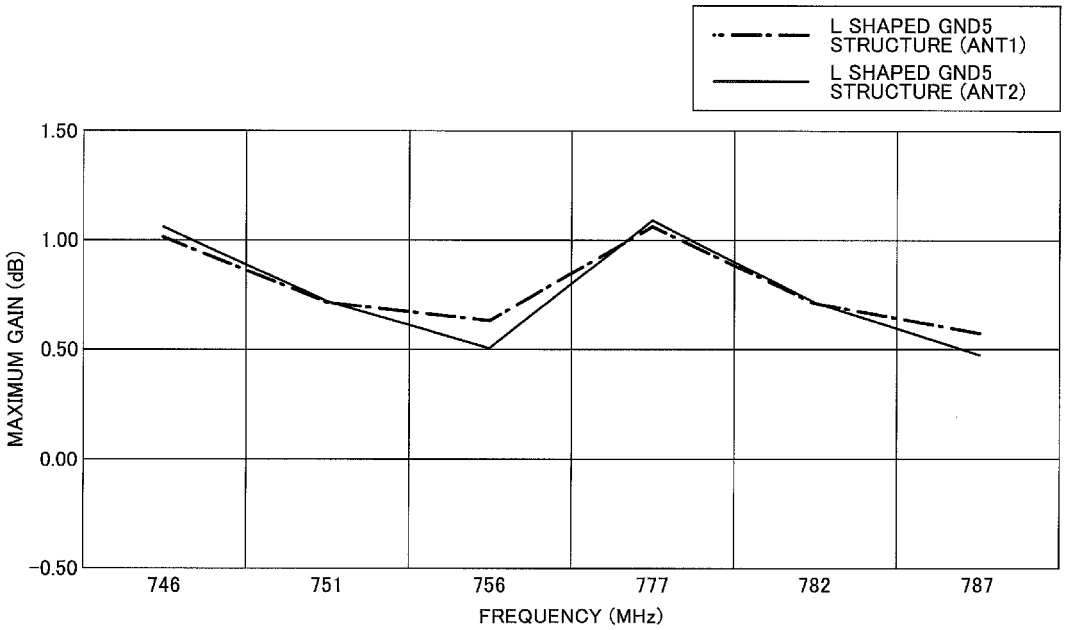
FIG. 16 illustrates the frequency dependence of the maximum gain in the 700 MHz band, with respect to the two antennas (ANT1, ANT2) in the radio device (L shaped GND5 structure)

FIG. 16 illustrates the frequency dependence of the maximum gain in the 700 MHz band, with respect to the two antennas (ANT1, ANT2) in the radio device (L shaped GND5 structure) illustrated in FIG. 2. As illustrated in FIG. 16, in substantially the entire 700 MHz band, the maximum gain of the first antenna ANT1 is indicating favorable values that are at the same level as the maximum gain of the second antenna ANT2.

Figure 17:
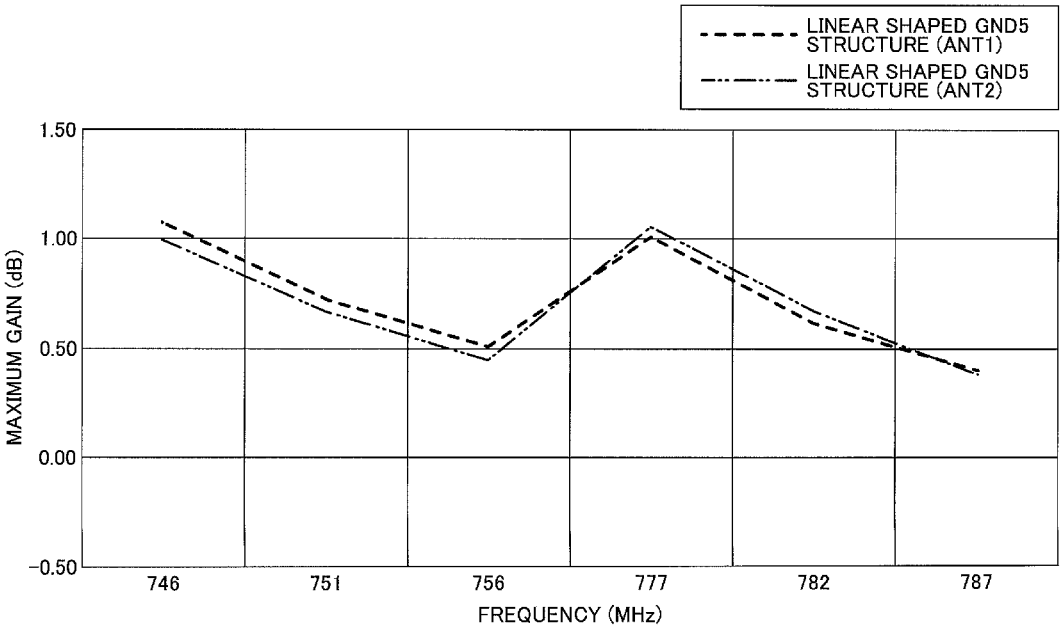
FIG. 17 illustrates the frequency dependence of the maximum gain in the 700 MHz band, with respect to the two antennas (ANT1, ANT2) in the radio device (linear shaped GND5 structure)

FIG. 17 illustrates the frequency dependence of the maximum gain in the 700 MHz band, with respect to the two antennas (ANT1, ANT2) in the radio device (linear shaped GND5 structure) illustrated in FIG. 6. As illustrated in FIG. 17, in substantially the entire 700 MHz band, the maximum gain of the first antenna ANT1 is indicating favorable values that are at the same level as the maximum gain of the second antenna ANT2.

Figure 18:
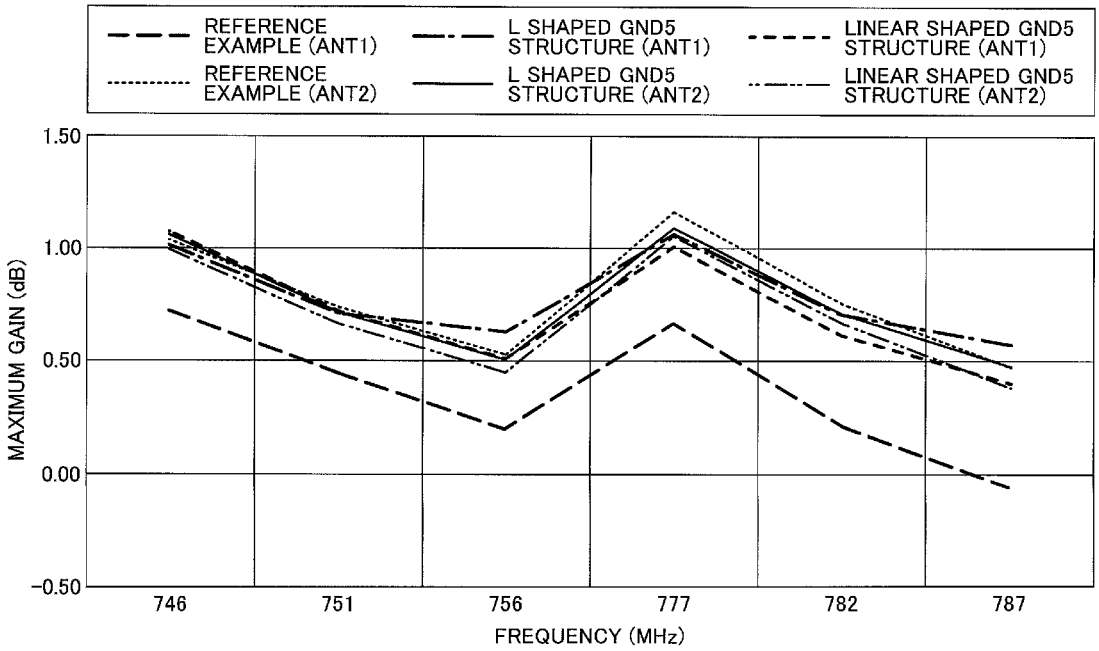
FIG. 18 illustrates the frequency dependencies of the maximum gain in the 700 MHz band in a superposed manner.

FIG. 18 illustrates a graph in which FIGS. 15, 16 and 17 are superposed. Among the six graph lines, the graph line of the reference example (ANT1) is indicating a degraded maximum gain compared to the other five graph lines. When the additional ground GND5 is formed, the frequency dependence of the maximum gain of the first antenna ANT1 (the antenna on the side where the cutout is formed) is improved by more than approximately 0.25 dB through approximately 0.5 dB across the entire 700 MHz band.

6. Overview

In the radio device according to the embodiment, the first antenna ANT1 and the second antenna ANT2 respectively form monopole type antennas (for example, FIGS. 9 through 13). Using a monopole type antenna is preferable from the perspective of reducing the size of the radio device.

Figure 19A:
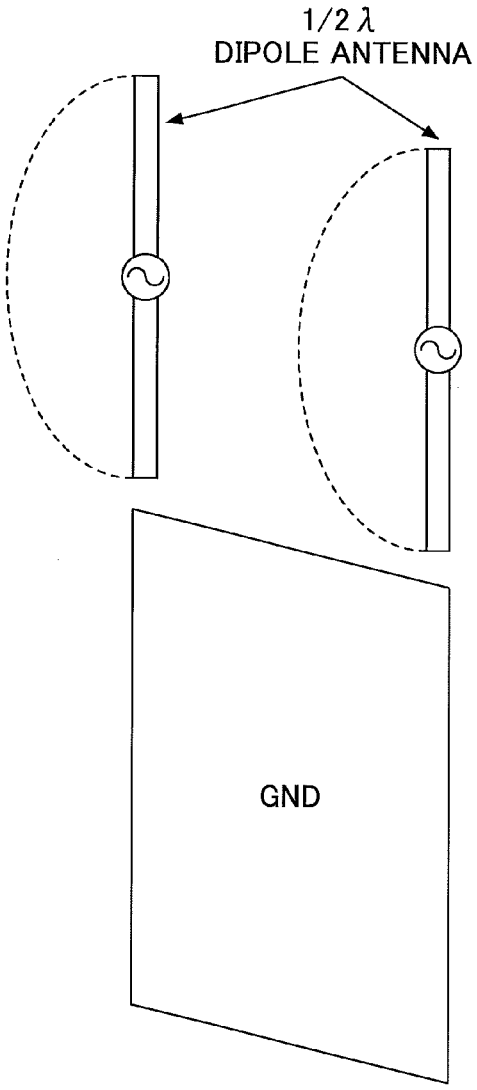
FIG. 19A illustrates an example where a first antenna ANT1 and a second antenna ANT2 are formed by $\lambda/2$ dipole antennas.
Figure 19B:
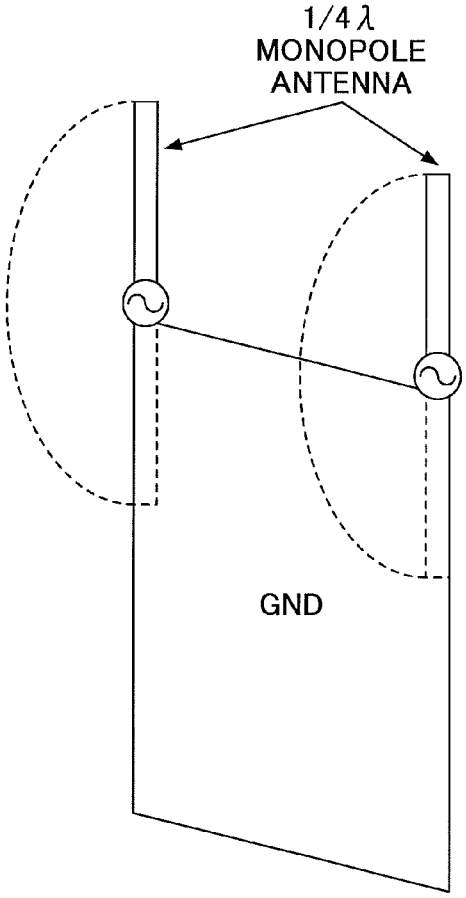
FIG. 19B illustrates an example where the first antenna ANT1 and the second antenna ANT2 are formed by $\lambda/4$ monopole antennas.

FIG. 19A illustrates an example where the first antenna ANT1 and the second antenna ANT2 of the radio device are respectively formed of $\lambda/2$ dipole antennas. FIG. 19B illustrates an example where the first antenna ANT1 and the second antenna ANT2 of the radio device are respectively formed of $\lambda/4$ monopole antennas. Here, $\lambda$ indicates the wavelength of radio waves.

As described with respect to FIG. 1, the small-size cell base station is an example of a radio device. A small-size cell base station for controlling communication in a femto cell is preferably provided indoors such as inside a house or inside a company, and is thus preferably more compact than a macrocell base station. The radio device according to the embodiment, which is preferable from the perspective of reducing the size of the device, is preferably used as a small-size cell base station such as a femto cell base station.

In the radio station according to the embodiment, when an area of a cutout is formed in the main ground GND1, by providing the additional ground GND5, it is possible to exert favorable antenna properties (for example, the maximum gain) that are the same level as those of a case where a cutout is not formed. Therefore, the radio device according to the embodiment is preferable from the perspective of alleviating the degradation in antenna properties, by making the antenna properties less dependent on the shape of the ground.

As described with respect to FIG. 2, there are cases where a cutout is formed in the main ground GND1, from the perspective of increasing the breakdown voltage of the connector to greater than or equal to a predetermined value. Therefore, the radio device according to the embodiment, in which the antenna properties are less dependent on the shape of the ground, is also preferable from the perspective of securing the breakdown voltage of the connector.

As described with respect to FIG. 2, the properties of the antenna (in FIG. 2, the first antenna ANT1) on the side where the cutout is formed, are likely to be degraded, as the frequency of the radio waves is lower (as the wavelength is longer). Therefore, the radio device according to the embodiment, in which the antenna properties are less dependent on the shape of the ground, is also preferable from the perspective of transmitting and receiving radio waves of a low frequency (for example, the platinum band).

The radio device of the embodiment is preferable from the perspective of making the properties (for example, the maximum gain) of a plurality of antennas used in a MIMO method, to be less dependent on the shape of the ground. Therefore, from the perspective of transmitting and receiving radio waves by the plurality of antennas having the same level of excellent properties, the radio device according to the embodiment is also preferable from the perspective of enhancing high speed and high quality of the MIMO method.

In a mobile communication system using the MIMO method, the radio device according to the embodiment is preferably used as a small-size femto cell base station that performs wired communication with a core network and wireless communication with a user device at a low frequency.

According to an aspect of the embodiments, it is possible to alleviate the degradation of the properties of a monopole type antenna.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A radio device comprising:

a substrate having a rectangular shape including a first edge side and a second edge side constituting opposite sides and a third edge side and a fourth edge side constituting another set of opposite sides;

a ground plane formed on a surface layer of the substrate and including a cut-out area where the ground plane is cut out, the cut-out area extending along the third edge side from a corner part of the substrate lying at one end of the second edge side;

a first antenna element of a monopole type that extends away from the ground plane along the third edge side from a first feeding unit provided in a vicinity of the third edge side on the substrate;

a second antenna element of a monopole type that extends away from the ground plane along the fourth edge side from a second feeding unit provided in a vicinity of the fourth edge side on the substrate; and a ground element formed on an inner layer inside the substrate in the cut-out area, the inner layer lying beneath the surface layer, the ground element connected at one end to the ground plane and extending along the third edge side from the one end of the ground element to the one end of the second edge side, wherein a total length of a length of the ground plane along the third edge side from the first feeding unit to the one end of the ground element and a length of the ground element along the third edge side from the one end to the other end of the ground element corresponds to a length of one fourth of a wavelength of radio waves that are transmitted and received.

2. The radio device according to claim 1, wherein the first feeding unit is provided at a corner part on one side of one end of the first edge side, and the second feeding unit is provided at a corner part on one side of another end of the first edge side.

3. The radio device according to claim 1, wherein the ground element extends linearly in the cut-out area.

4. The radio device according to claim 1, wherein the ground element extends in an L shape in the cut-out area.

5. The radio device according to claim 1, wherein the one end of the ground element is connected to the ground plane via a capacitor.

6. The radio device according to claim 1, wherein the one end of the ground element is connected to the ground plane, and the other end of the ground element is not connected to the ground plane.

7. The radio device according to claim 1, wherein both the one end of the ground element and the other end of the ground element are connected to the ground plane.

8. The radio device according to claim 1, wherein in the cut-out area, at least one LAN connector is provided.

9. The radio device according to claim 1, wherein the radio waves have a frequency of a 700 MHz band through a 900 MHz band.

* * * * *